US005193316A

United States Patent [19]

Olmstead

[11] Patent Number: 5,193,316

[45] Date of Patent: Mar. 16, 1993

[54] SEMICONDUCTOR WAFER POLISHING USING A HYDROSTATIC MEDIUM

[75] Inventor: Dennis L. Olmstead, Sherman, Tex.

[73] Assignee: Texas Instruments Incorporated, Dallas, Tex.

[21] Appl. No.: 784,491

[22] Filed: Oct. 29, 1991

[51] Int. Cl.[5] ..... B24B 7/10; B24B 7/22

[52] U.S. Cl. ..... 51/281 SF; 51/283 R; 51/131.1; 51/131.2; 51/131.4; 51/236

[58] Field of Search ..... 51/109 R, 129, 131.1, 51/131.2, 131.3, 131.4, 132, 236, 216 LP, 217 L, 237 R, 216 T, 281 SF, 283 R, 237 M

[56] References Cited

U.S. PATENT DOCUMENTS

| | | | |
|---|---|---|---|
| 3,841,031 | 10/1974 | Walsh | 51/131.4 |
| 3,898,770 | 8/1975 | Benz et al. | 51/131.2 |
| 4,270,316 | 6/1981 | Krämer et al. | 51/131.4 |
| 4,512,113 | 4/1985 | Budinger | 51/216 LP |
| 4,519,168 | 5/1985 | Cesna | 51/237 R |
| 4,897,966 | 2/1990 | Takahashi | 51/237 R |
| 4,944,119 | 7/1990 | Gill, Jr. et al. | 51/283 R |

FOREIGN PATENT DOCUMENTS

| | | | |
|---|---|---|---|
| 0052967 | 3/1988 | Japan | 51/131.4 |

*Primary Examiner*—Bruce M. Kisliuk
*Assistant Examiner*—Bryan Reichenbach
*Attorney, Agent, or Firm*—W. James Brady, III; B. Peter Barndt; Richard L. Donaldson

[57] ABSTRACT

A method and apparatus for polishing semiconductor wafers in which a force applied to the wafer is uniformly distributed across a surface of the wafer during polishing using a hydrostatic or compliant material situated between the wafer and a piston. In a preferred embodiment, the hydrostatic or compliant material is an elastic solid or fluid filled bag. One or more teflon disks or teflon coated surfaces may be included between the hydrostatic or compliant material and a second compliant layer to form a bearing to allow the wafer to rotate about its central axis during polishing.

13 Claims, 2 Drawing Sheets

SEMICONDUCTOR WAFER POLISHING USING A HYDROSTATIC MEDIUM

FIELD OF THE INVENTION

This invention relates to semiconductor wafer processing, and more particularly to a method and apparatus for polishing semiconductor wafers using a hydrostatic medium.

BACKGROUND OF THE INVENTION

In polishing semiconductor wafers, the wafer is placed in a template which is moved over a polishing pad. In the wax mount process where the semiconductor wafer is mounted on a mounting plate with a wax, the wafer does not rotate, and the process is critically dependent upon the cleanliness and mechanical perfection of the wafer, the mounting plate to which the wafer is attached, and the head which applies force to the mounting plate. Other template designs neither facilitate a truly uniform pressure on the backs of the wafers nor have low friction surfaces to allow rotation of each wafer on its own axis.

BRIEF SUMMARY OF THE INVENTION

The invention is a method and apparatus for polishing semiconductor wafers in which a force is uniformly applied to each wafer during polishing. A non-rigid hydrostatic surface, which is not sensitive to mechanical imperfections of the polisher components and cleanliness of the surface, is used in the polishing process. The polishing process is not sensitive to mechanical imperfections of the polishing equipment, non-uniform slurry flows, non-uniform temperatures and polish pad imperfections.

The apparatus uses a conventional polishing template that polishes one or more wafers. A fluid filled polyethylene bag with a teflon disk is placed between the polishing piston and pad of compliant material. The fluid filled bag applies a uniform force across the pad of compliant material and the surface of the semiconductor wafer. A second teflon disk may be placed between the teflon disk associated with the fluid filled bag and the pad of compliant material.

The technical advance represented by the invention as well as the objects thereof will become apparent from the following description of a preferred embodiment of the invention when considered in conjunction with the accompanying drawings, and the novel features set forth in the appended claims.

DESCRIPTION OF A PREFERRED EMBODIMENT

Figure 1:
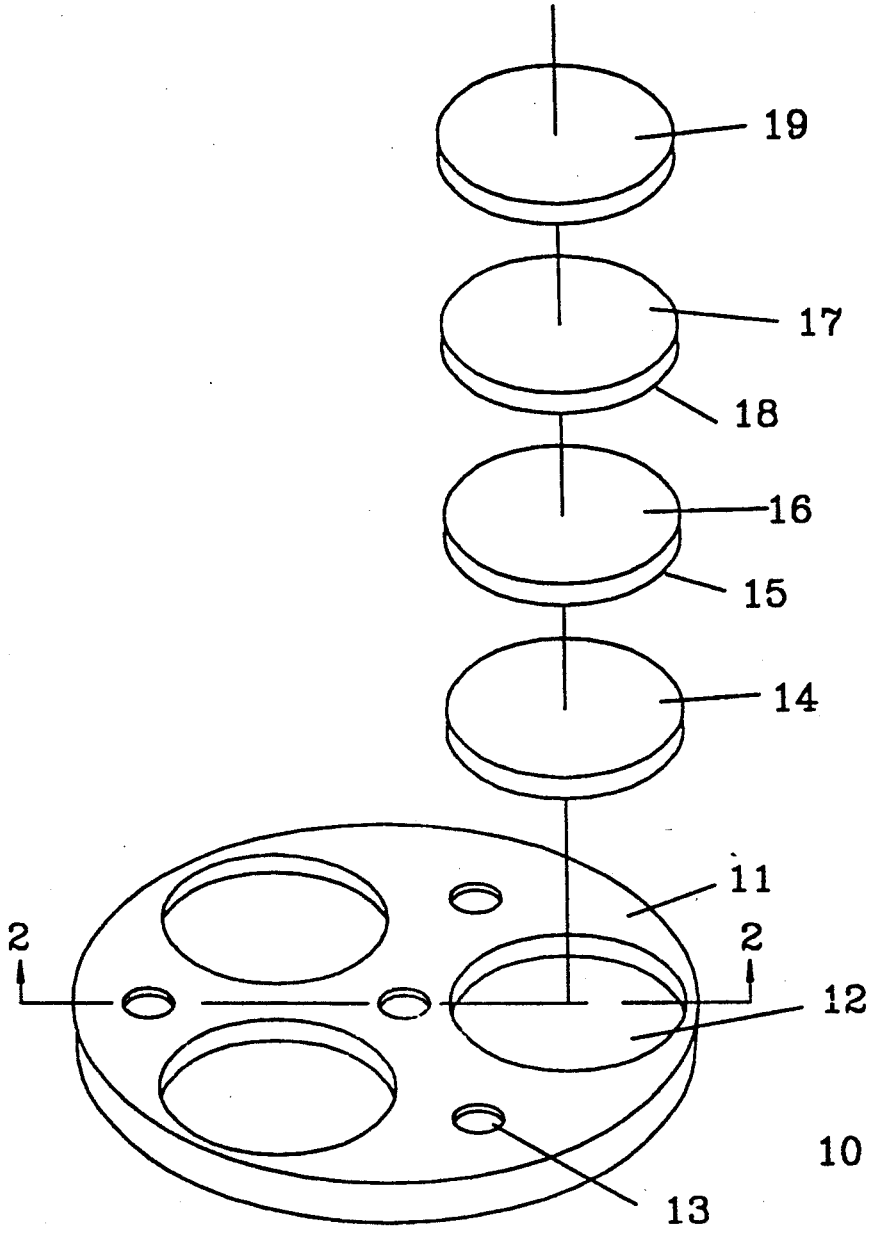
FIG. 1 is an exploded view of the polishing apparatus of the present invention.

FIG. 1 is an exploded view 10 of a part of the polishing apparatus, illustrating the various parts utilized in polishing a semiconductor wafer. A template 11 has a plurality of openings 12 in which individual semiconductor wafers are polished. A plurality of openings 13 are in the face of the template to hold springs which provide a spring interface with a polish head, as illustrated in FIG. 2.

A semiconductor wafer, 14 is placed into one of the openings 12. A pad of compliant (i.e. flexible) material, for example, a polish pad, 15 is positioned over the wafer 14 to decrease sensitivity to particles on the back side of the wafer. Compliant material 15 may have a teflon surface coating 16, or a separate teflon disk may be placed over compliant material 15. A fluid filled polyethylene bag 17 is placed over compliant material 15. The fluid in the bag may be, for example, water or any other fluid, or an elastic solid such as rubber. Bag 17 may have a teflon surface 18, or a separate teflon disk may be used. A piston 19 of, for example, polypropylene is positioned over the fluid filled bag 17 to apply pressure on the bag 17, compliant material 15 and semiconductor wafer 14.

Figure 2:
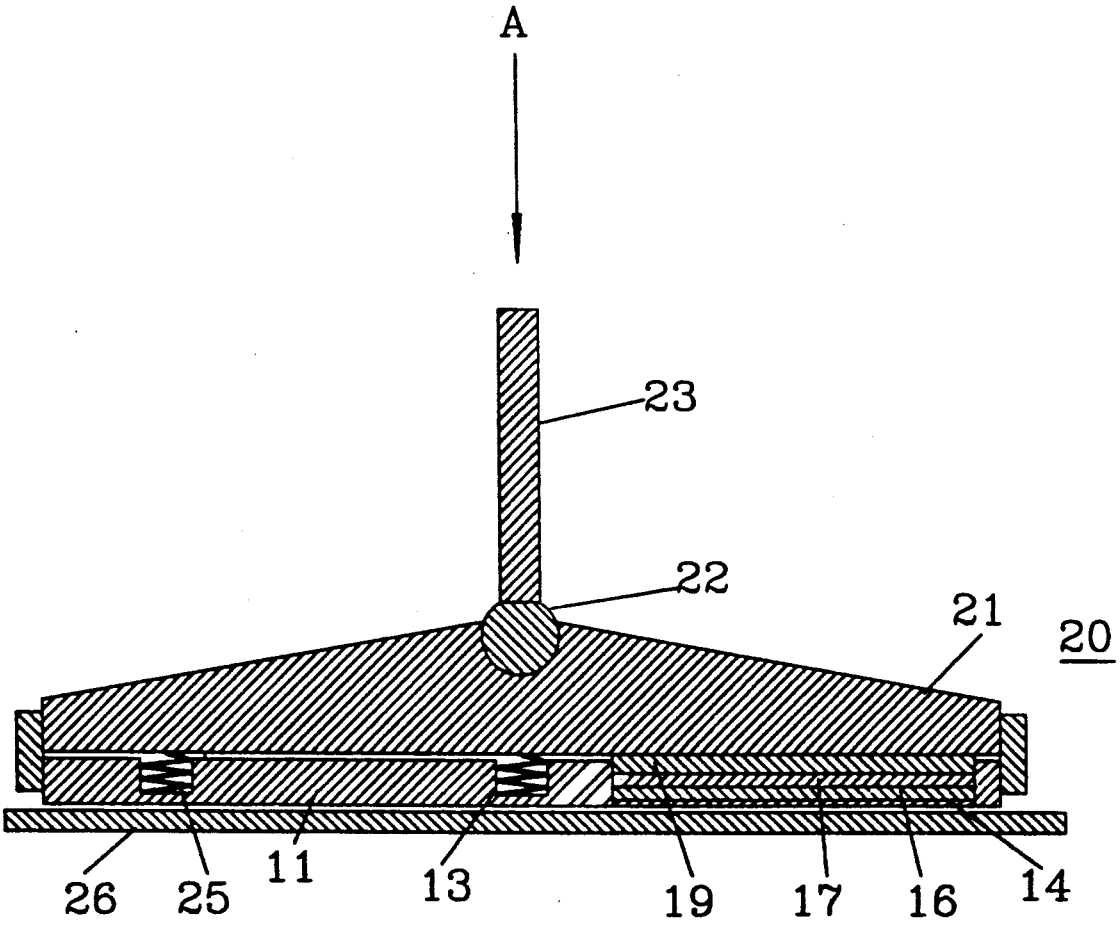
FIG. 2 is a cross-sectional view of the polishing apparatus.

FIG. 2 is a cross-sectional view of a polishing apparatus with the various parts in position to polish a semiconductor wafer. Template 11 is over a polish pad 26 that is larger than the template. Wafer 14 is in contact with polish pad 26 and held against the pad 26 by compliant material 15, bag 17 and piston 19. A downward pressure is exerted on piston 19 by polish head 21. Polish head 21 transmits force exerted at A to piston 19. Polish head 21 also engages springs 25 in openings 13 of template 11, keeping template 11 in contact with polish pad 26.

The polishing assembly 20 is rotated while an abrasive slurry is applied to the surface of semiconductor wafer 14 to be polished. Bag 17, under the force of piston 19, applies a uniform pressure over the surface of compliant material 15, which in turn applies a uniform polishing pressure to wafer 14. Surface irregularities in piston 19 do not affect the evenly applied pressure resulting from fluid bag 17. In the event that an uneven pressure were applied to wafer 14, it would polish in a non-uniform manner, generating an non-flat polished surface. Under the uniform pressure applied to surface of wafer 14 by compliant material 15, wafer 14 will experience uniform surface polishing. The free rotation is accomplished by the teflon interfaces between fluid bag 17 and compliant material 15.

In an alternative embodiment, the fluid filled bag is replaced with a disk of soft rubber, which also applies a uniform pressure over the surface of the compliant material.

What is claimed:

1. An apparatus for urging semiconductor wafers into contact with a polishing pad, comprising:
   - a movably supported piston means for providing a driving force to be applied to a wafer; and
   - a flexible linkage means contacting said wafer and operatively responsive to movement of said piston means for distributing the force from said piston means uniformly onto the wafer without using any rigid force transmitting components, said flexible linkage means including a hydrostatic means for effecting force transfer, said hydrostatic means including a fluid which is displaced toward the wafer in response to movement of said piston means.

2. An apparatus according to claim 1, wherein said hydrostatic means is a flexible bag which contains a fluid therein.

3. An apparatus according to claim 2, including a template having a pair of generally parallel, oppositely facing surfaces, said template having a through opening which extends generally perpendicularly between said surfaces and which receives therein a wafer for polishing, said piston means and said bag being disposed in contacting relationship with each other within said through opening, said piston means including a piston projecting from said through opening outwardly beyond one of said surfaces, said flexible linkage means including a flexible pad disposed in said through opening for directly contacting the wafer during polishing thereof, said bag being interposed between said piston and said flexible pad, said flexible pad being movable in response to displacement of said fluid by said piston means to urge the wafer outwardly toward the other said surface of said template and into contact with the polishing pad, said flexible pad being operable to reduce the effect of particles which might otherwise produce areas of relatively high pressure on the wafer during polishing.

4. An apparatus according to claim 3, wherein said flexible linkage means includes a pair of opposed teflon disks interposed between said bag and said flexible pad, said teflon disks being held in contacting relationship between said bag and said flexible pad during polishing, said teflon disks defining between said bag and said flexible pad a rotational bearing which permits substantially free rotation of said flexible pad relative to said bag and said template during polishing.

5. An apparatus according to claim 4, wherein said template includes a plurality of said openings having respective said piston means, fluid-containing bags, flexible pads and teflon disks disposed therein, said template having a generally circular shape and said openings being arranged therein in circumferentially spaced relationship, said one surface of said template having a plurality of blind openings formed therein, said blind openings extending generally parallel to said through openings, each said blind openings having a compression spring seated therein and projecting therefrom outwardly beyond said one surface, and including a polish head disposed in adjacent opposed relationship relative to said one surface of said template, said polish head being movable toward said template to engage and drive said compression springs and said pistons further into their respective openings so that said template and the wafers received therein for polishing are urged into contact with the polishing pad.

6. An apparatus according to claim 5, wherein said polish head is rotatable in a plane generally parallel to said template surfaces, said template being attached to said rotatable polish head for rotation therewith, said flexible pads being carried within said through openings for planetary motion during rotation of said template, said flexible pads being cooperable with said template during said planetary motion to effect rotational motion of said flexible pads relative to said template, said rotational and planetary motion of said flexible pads being imparted by said flexible pads to the wafers during polishing.

7. An apparatus according to claim 6, wherein said bags are polyethylene, said fluid is water, and said flexible pads are polish pads.

8. An apparatus according to claim 3, wherein said bag and said flexible pad have respective teflon surface portions arranged in opposed relationship with each other and held in contacting relationship during polishing, said teflon surface portions defining between said bag and said flexible pad a rotational bearing which permits substantially free rotation of said flexible pad relative to said bag and said template during polishing.

9. An apparatus according to claim 8, wherein said template includes a plurality of said openings having respective said piston means, fluid-containing bags, flexible pads and teflon disks disposed therein, said template having a generally circular shape and said openings being arranged therein in circumferentially spaced relationship, said one surface of said template having a plurality of blind openings formed therein, said blind openings extending generally parallel to said through openings, each said blind opening having a compression spring seated therein and projecting therefrom outwardly beyond said one surface, and including a polish head disposed in adjacent opposed relationship relative to said one surface of said template, said polish head being movable toward said template to engage and drive said compression springs and said pistons further into their respective openings so that said template and the wafers received therein for polishing are urged into contact with the polishing pad.

10. An apparatus according to claim 9, wherein said polish head is rotatable in a plane generally parallel to said template surfaces, said template being attached to said rotatable polish head for rotation therewith, said flexible pads being carried within said through openings for planetary motion during rotation of said template, said flexible pads being cooperable with said template during said planetary motion to effect rotational motion of said flexible pads relative to said template, said rotational and planetary motion of said flexible pads being imparted by said flexible pads to the wafers during polishing.

11. An apparatus according to claim 10, wherein said bags are polyethylene, said fluid is water, and said flexible pads are polish pads.

12. A method of polishing a semiconductor wafer, comprising the steps of:

providing a polishing pad;

providing an input driving force directed toward the polishing pad with a piston;

interposing the wafer between the piston and the polishing pad;

using the input driving force to urge the wafer against the polishing pad, including the step of distributing the input driving force uniformly onto the wafer without using any rigid force transmitting components between the piston and the wafer; and said force distributing step including the steps of interposing between the piston and the wafer a hydrostatic means including a fluid for transferring force, and applying the driving force to the hydrostatic means to displace the fluid toward the wafer.

13. An apparatus for urging semiconductor wafer into contact with a polishing pad, comprising:

a generally circular template having a pair of generally parallel, oppositely facing surfaces, said template having a plurality of through openings which extend generally perpendicularly between said surfaces and which each receive therein a wafer for polishing, said through openings being arranged in circumferentially spaced relationship around said template, one said surface of said template having a plurality of blind openings formed therein, said blind openings extending generally parallel to said through openings;

a plurality of pistons movably supported within the respective through openings for providing a driving force to be applied to the wafers, said pistons projecting from said through openings outwardly beyond said one surface;

a plurality of flexible bags disposed respectively within said through openings in contacting relationship with the respective pistons, each said bag containing a fluid therein which is displaced toward the associated wafer in response to movement of the associated piston;

a plurality of flexible pads disposed respectively in said through openings for directly contacting the respective wafers during polishing thereof, said bags being interposed between the respective pistons and flexible pads, said flexible pads being movable in response to displacement of said fluid by said pistons to urge the wafers outwardly toward the other said surface of said template and into contact with the polishing pad, said flexible pads being operable to reduce the effect of particles which might otherwise produce areas of relatively high pressure on the wafer during polishing;

each said bag and the associated flexible pad having respective teflon surface portions arranged in opposed relationship with each other and held in contacting relationship during polishing, said teflon surface portions defining between said bags and said flexible pads a plurality of rotational bearings which permit substantially free rotation of said flexible pads relative to said bags and said template during polishing;

a plurality of compression springs seated respectively in said blind openings of said template and projecting therefrom outwardly beyond said one surface; and a polish head disposed in adjacent opposed relationship relative to said one surface of said template, said polish head being movable toward said template to engage and drive said compression springs and said pistons further into their respective openings so that said template and the wafers received therein for polishing are urged into contact with the polishing pad, said polish head being rotatable in a plane generally parallel to said template surfaces, said template being fixed to said rotatable polish head for rotation therewith, said flexible pads being carried within said through openings for planetary motion during rotation of said template, said flexible pads being cooperable with said template during said planetary motion to cause rotational motion of said flexible pads relative to said template, said rotational and planetary motion of said flexible pads being imparted by said flexible pads to the wafers during polishing.

* * * * *